US005174751A

United States Patent [19]

Chapman et al.

[11] Patent Number: 5,174,751

[45] Date of Patent: Dec. 29, 1992

[54] MOBILE INFRARED HEATER

[76] Inventors: Jacky L. Chapman; John J. Rinehart; Ralph Rinehart, all of P.O. Box 1189, Beckley, W. Va. 25802

[21] Appl. No.: 606,176

[22] Filed: Oct. 31, 1990

[51] Int. Cl.[5] ..... F24J 3/00; F24C 3/00; E01C 23/14; F24D 15/02

[52] U.S. Cl. ..... 432/227; 432/221; 432/225; 432/229; 126/91 R; 404/95

[58] Field of Search ..... 432/88, 221, 225, 227, 432/229; 126/91 A, 91 R; 404/95

[56] References Cited

U.S. PATENT DOCUMENTS

| | | | |
|---|---|---|---|
| 1,704,873 | 3/1929 | Strout . | |
| 2,057,776 | 10/1936 | Groven | 219/45 |
| 2,295,177 | 9/1942 | King | 263/19 |
| 2,317,426 | 4/1943 | Wilson | 219/34 |
| 2,414,214 | 1/1947 | Spackman | 280/9 |
| 2,464,165 | 3/1949 | Williams, Jr. | 263/19 |
| 2,500,872 | 3/1950 | Root et al. | 219/34 |
| 2,521,232 | 9/1950 | Lashells | 219/34.1 |
| 2,613,307 | 10/1952 | Mirand | 219/19 |
| 2,761,948 | 9/1956 | Todd | 219/35 |
| 3,045,100 | 7/1962 | Mills | 219/34 |
| 3,134,582 | 5/1964 | Robson | 263/19 |
| 3,201,098 | 8/1965 | Muckelrath | 432/88 X |
| 3,233,077 | 2/1966 | Miller | 219/205 |
| 3,454,266 | 7/1969 | Mattingly | 263/19 |
| 3,525,326 | 8/1970 | Deal | 432/88 X |
| 3,809,527 | 5/1974 | Newman | 432/62 |
| 4,039,279 | 8/1977 | Horeczko | 432/225 |
| 4,499,365 | 2/1985 | Puziss | 219/205 |
| 4,682,909 | 7/1987 | Mihara | 404/95 X |
| 4,781,491 | 11/1988 | Chiba et al. | 404/95 |
| 4,806,194 | 2/1989 | Wald | 432/229 X |
| 4,823,768 | 4/1989 | Schmidt et al. | 126/91 R |

OTHER PUBLICATIONS

The Blackwell Burner Co. Catalogue, pp. 1-6, 8-10, 12, 13 and 15 and form MRM-83.

"Space-Ray" Specification Sheet, Space-Ray Division, Gas-Fired Products, Inc. copyright 1986.

*Primary Examiner*—Henry A. Bennet
*Assistant Examiner*—Christopher Kilner

[57] ABSTRACT

A mobile fossil fuel heating device allows almost any indoor or outdoor area to be heated with radiant heat. A radiant tube gas burning heater is mounted on a wheeled carriage for rotation about a horizontal axis so that the radiating face of the heater may be positioned in a desired orientation. Once positioned, the heater is held in that position by a clamp arrangement. The fossil fuel for powering the heater may comprise a number of propane tanks mounted on the carriage, and shielded from the heater by infrared shields. Hollow shafts mount the heater for rotation, and a fuel conduit, and an electrical wire, pass through one of the shafts to supply fuel and power to the heater while not interfering with the rotation of the heater.

18 Claims, 3 Drawing Sheets

MOBILE INFRARED HEATER

BACKGROUND AND SUMMARY OF THE INVENTION

There are many situations in which it is desirable to have heat at a cold indoor location, or an outdoor location, for the purpose of facilitating human activities, or for keeping equipment warm so that it will function properly. For example, there are many situations when construction is being practiced, heavy equipment is being stored or repaired, aircraft is exposed to a cold environment while on the ground, or for outdoor sporting events in cold weather, when a heat source is desirable.

Prior art constructions provide the general teaching of utilizing mobile heat sources for facilitating outdoor endeavors. However, many of such prior art devices require a continuous connection up to a source of electricity for a major or the only source of power, which is not always convenient; or burn fossil fuels to provide forced air heat. Also, it is often difficult to properly orient prior art outdoor heaters or the like to take maximum advantage of the utility thereof.

According to the present invention, a portable space heating assembly is provided which is mobile, yet provides radiant heat from the burning fossil fuels. The fossil fuel source can be mounted directly on the carriage with which the heater is associated. The assembly according to the present invention is extremely versatile, it being possible to locate it in a wide variety of different orientations in order to take maximum advantage of the utility thereof.

According to one aspect of the present invention, a portable space heating assembly is provided which comprises a carriage mounted on wheels, an infrared, fossil fuel powered space heater having a radiant face, and a means for mounting the heater on a carriage for rotation about an axis. The mounting of the heater for rotation can be accomplished by a pair of upright supports engaging hollow shaft stubs extending from the ends of the space heater, and the mounting is such that the orientation of the radiating face with respect to the carriage may be changed, yet the heater may be maintained in the position to which it has been rotated. A conduit connects the heater to a source of fossil fuel so that there is no interference with the rotation of the heater about its axis of rotation—e.g. by feeding in a gas (e.g. propane) conduit through one of the hollow shaft stubs mounting the unit for rotation. Propane tanks, or the like, may be mounted directly on the carriage to provide the source of fossil fuel.

Infrared shielding may be provided for shielding the propane tanks from heat from the heater, and shielding of gas lines utilizing components of the carriage may also be provided. The carriage preferably has a primarily open support surface so that the radiating face of the heater may be pointed downwardly to radiate heat through the open support surface to heat the space below the support. A tow hitch is provided on the front of the carriage so that it may be readily pulled by a motor vehicle. The heater is clamped in any position to which it has been rotated, and if desired a stop can be provided to prevent the carriage from executing more than one revolution (so that the fuel conduit does not become twisted).

According to another aspect of the present invention, a method of space heating a cold area utilizing an infrared fossil fuel powered space heater mounted on a mobile carriage is provided. The method comprises the steps of: (a) transporting the mobile carriage to a cold area by towing it to the cold area with a motor vehicle; (b) initiating supply and combustion of fossil fuel to the space heater at the cold area so that heat radiates from the radiating face thereof; and (c) rotating the heater about its axis to position the radiating face in a desired orientation in the cold area to heat the cold area as desired.

It is the primary object of the present invention to provide for the effective radiant space heating of a cold environment to facilitate human activities or the storage of equipment. This and other objects of the invention will become clear from an inspection of the detailed description of the invention, and from the appended claims.

DETAILED DESCRIPTION OF THE DRAWINGS

Figure 1:
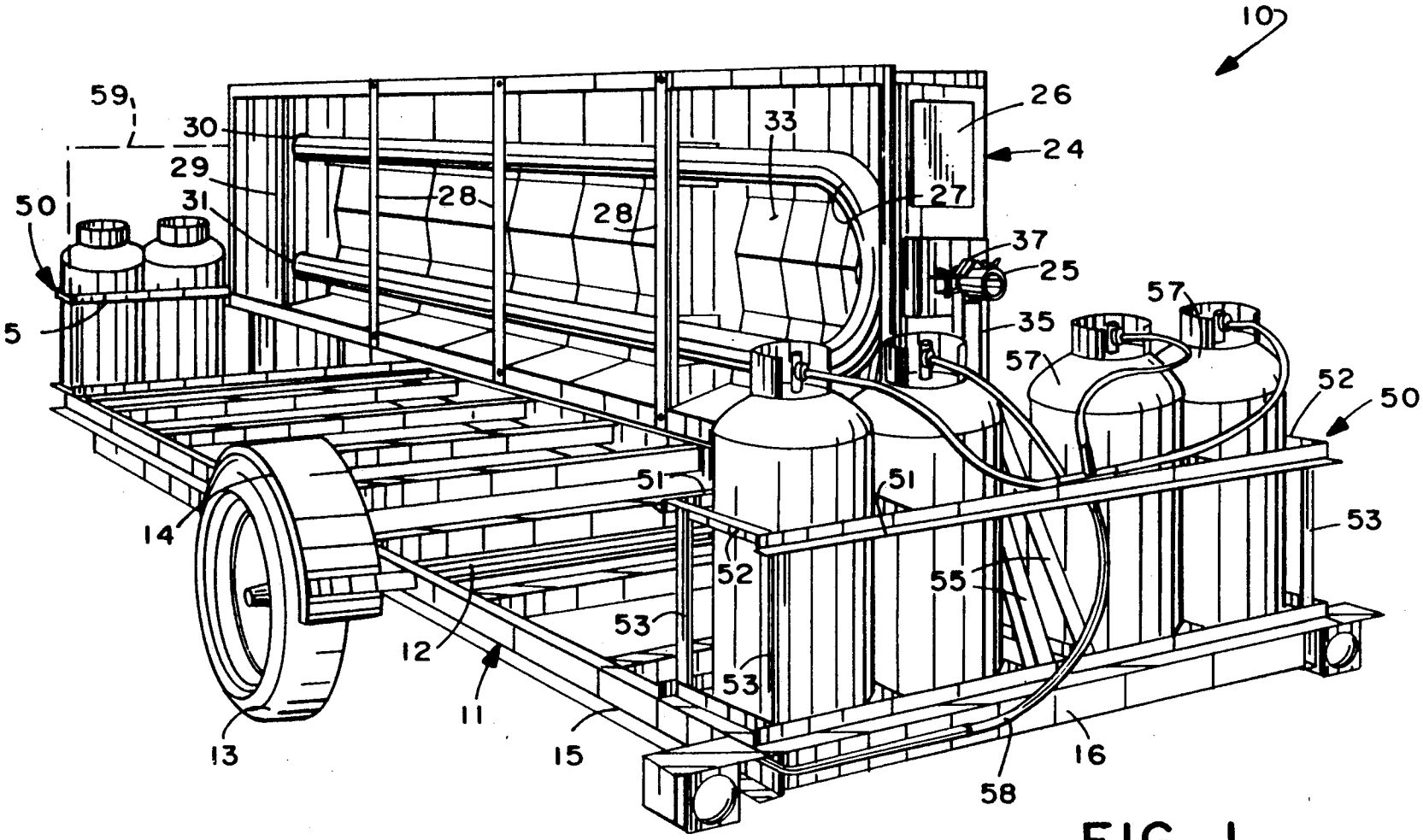
FIG. 1 is a rear perspective view of an exemplary portable space heating assembly according to the invention.

A portable space heating assembly 10 according to the present invention includes as one of the main components thereof a carriage 11 including an axle 12, mounting wheels 13. Fenders 14 may be provided over the wheels 13. The carriage 11 includes a pair of side supports 15 which may comprise channels or I-beams, and a plurality of cross supports, including front and rear cross supports 16, and intermediate cross supports 17 (see FIG. 2). The carriage 11 is constructed so that the vast majority of the support surface thereof is open, as indicated by open portions 18. In order to allow ready transport of the carriage 11, a conventional trailer hitch 20 is provided at the front thereof, including a handle 21 rotatable to adjust the wheel (not shown) mounted at the bottom thereof for balancing the carriage 11 when it is disconnected from a towing motor vehicle in the cold space which it is to be used to heat.

Another major component of the assembly 10 comprises an infrared fossil fuel powered space heater 24 having a radiating face, which radiating face is illustrated in FIG. 1. While a wide variety of radiant heaters may be utilized, using a wide variety of fossil fuel sources, one particularly useful heater—and the one illustrated in the drawings—is sold under the trademark "Space-Ray" by Gas-Fired Products, Inc. of Charlotte, N.C., Model No. RSTP17C. Such a heater comprises a casing 26, a U-shaped emitter tube 27, cross supports 28 for mounting the emitter tube 27, a casing end 29 providing a spark ignition system, fan, and the like, end connections 30, 31 for the tube 27 to the casing 29, and a highly polished reflector 33 opposite the open face of the heater 24 (between the supports 28) which reflects radiant heat through the open face.

Figure 2:
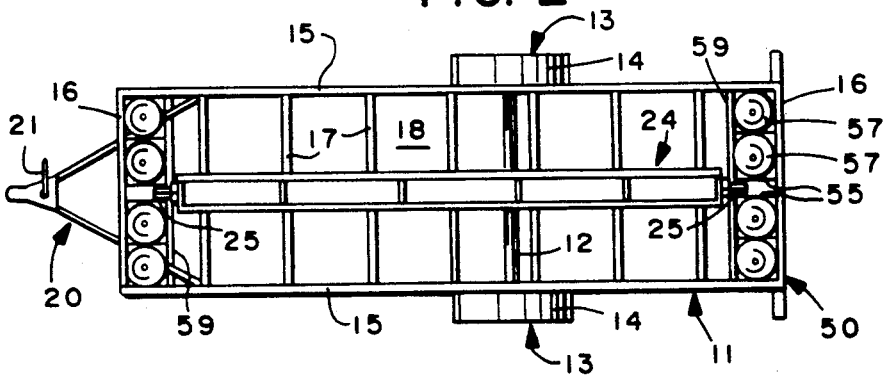
FIG. 2 is a top plan view of the assembly of FIG. 1 showing infrared shielding means.
Figure 3:
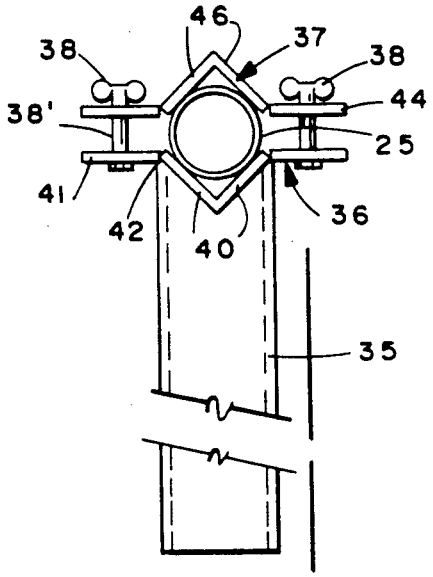
FIG. 3 is an end view of the mounting structure for the heater of the assembly of FIGS. 1 and 2.
Figure 4:
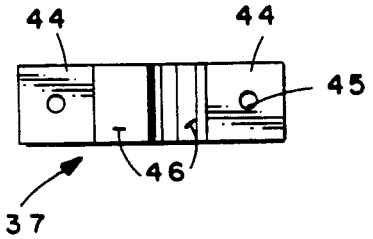
FIG. 4 is a top plan view of the top component of the structure of FIG. 3.
Figure 5:
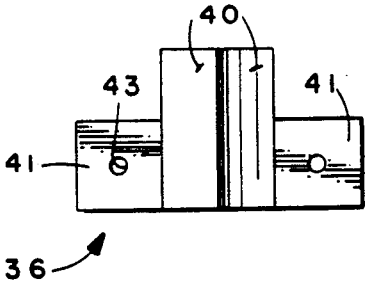
FIG. 5 is a plan view of the bottom component of the structure of FIG. 3.
Figure 6:
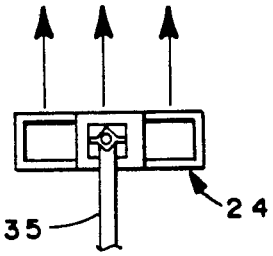
FIGS. 6 through 8 illustrate exemplary positions of the space heater of the assembly of FIGS. 1 and 2 with respect to the mounting structure.
Figure 7:
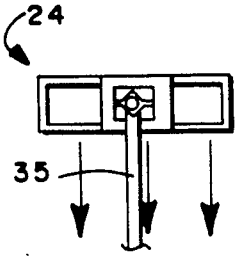
Figure 8:
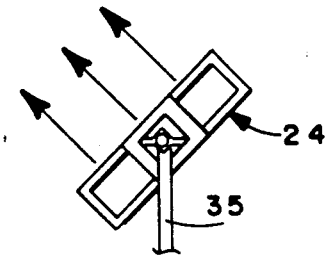

Means are also provided for mounting the heater 24 on the carriage 11 for rotation about an axis so that the orientation of the radiating face with respect to the carriage may be changed, yet the heater 24 may be maintained in the position to which it is rotated. The axis is preferably—as illustrated in FIGS. 1 and 2—a horizontal axis which essentially bisects the carriage 11 along its length, i.e. perpendicular to the horizontal axis defined by the axle 12. Such mounting means include a shaft stub 25—which is preferably hollow—connected at each end to the casing 26 or 29, a pair of upright supports 35 having a V-shaped element 36 at the bottom thereof and a cooperating oppositely directed V-shaped element 37 at the top thereof to define a shaft receiving opening (for the shaft 25), and locking structures—such as bolts 38' with wing nuts 38—for clamping the elements 36, 37 together. As illustrated in FIGS. 3 through 5, the element 36 includes the actual V-shaped leg portions 40 themselves, or the pair of horizontal ears 41 extending outwardly therefrom, having a welded connection—at 42—to the upright support 35, and with openings 43 formed in the ears 41 for receipt of the bolts 38' to which the Wing nuts 38 are connected. The upper structure 37 includes the V-legs 46, ears 44, and openings 45 for receipt of the bolts. The legs 40, 46 engage the hollow shaft stub 25. When one or both of the wing nuts 38 are loosened, the heater 24 may be rotated—by hand—about the horizontal axis defined by the shaft stubs 25. Once it has been rotated to the orientation desired, e.g. one of those in FIGS. 6 through 8, the wing nuts 38 are tightened and the heater 24 is held in that position.

Note that the bottom, support surface, for the carriage 11 is primarily open—as indicated by spaces 18—so that the heater 24 may be rotated to a position where the radiant surface thereof faces downwardly (FIG. 7) and may heat the space underneath the carriage 11. The carriage 11 is preferably made of steel, or other heat resistant material.

Heater 24 is powered by a fossil fuel source. The fossil fuels may be gases (e.g. propane, methane, coal gas, hydrogen, etc.) or liquids (e.g. oil, gasoline, alcohol, etc.). The source is preferably mounted directly on the carriage 11, such as by mounting means 50, which are cages having top intersecting welded channels 51, 52, upright channel supports 53, and the like (see FIG. 1). Angle supports 55 engage the upright supports 35 and support them, and the cages defined by the elements 51-53 contain propane tanks 57, or like sources of fossil fuel. A conduit 58 interconnected to a common connection element for all of the tanks 57 at the rear of the assembly 10 (as seen in FIG. 1) extends all the way up to the regulator at the front of the carriage 11, preferably being provided adjacent the outside face of the left hand side I-beam 15 (as viewed in FIG. 1), so that the conduit 58 is shielded from the heater 24.

It is desirable to provide upright shielding means for the tanks 57 so that the gas therein is not heated to such an extent that an explosion, or other safety hazard or malfunction, could occur. The shielding means are illustrated in FIG. 2 at reference numeral 59, and one shield (for the front tanks) is illustrated in dotted line at 59 in FIG. 1. A shielding means 59 may be made of any infrared shielding material, such as reflecting metal, an insulator, or the like, and preferably merely comprises rectangular shaped pieces mounted at the front and rear of the carriage 11 between heater 24 and the tanks 57, with the shaft stubs 25 passing through an opening formed therein, the shields 59 having a height higher than the top of the tanks 57 and almost as high as the top of the heater 24 when in the position illustrated in FIG. 1.

Figure 10:
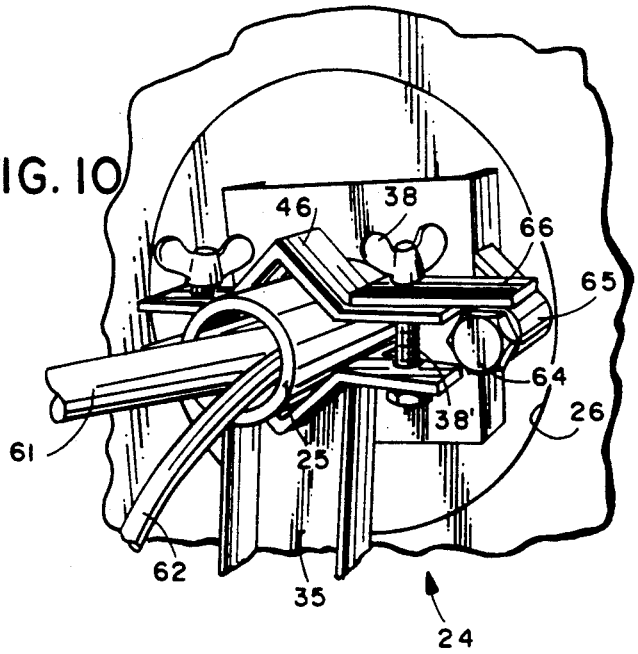
FIG. 10 is a detailed perspective view of the mounting structure at the front end of the heater of the assembly of FIGS. 1 and 2, shown mounted in a position for transport.
Figure 11:
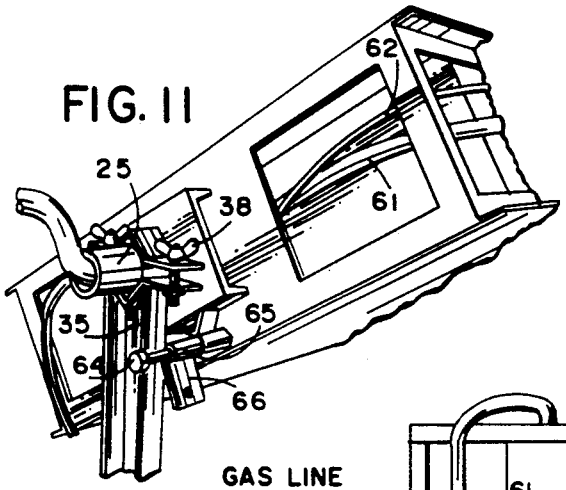
FIG. 11 is a view like that of FIG. 10 only showing the heater rotated to a stop position with respect to the mounting structure.
Figure 9:
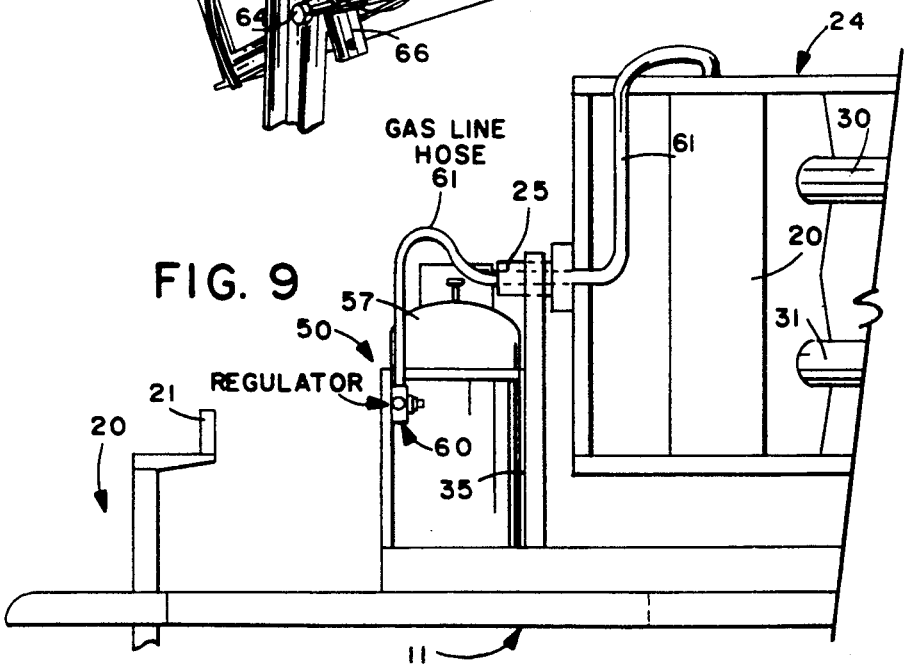
FIG. 9 is a detailed side view, partly in cross section and partly in elevation, of the front end of the assembly of FIGS. 1 and 2, illustrating an inner connection of the fossil fuel line to the heater.

The regulator for the gas lines is illustrated at 60 in FIG. 9. The regulator 60 is mounted at approximately the center along the width of the cage 50, therefore, the two closest gas tanks 57 as viewed in FIG. 9 have been removed for clarity of illustration. The regulator 60 is connected up to the conduit 58 and like conduits from the tanks 57 at the front of the carriage 11. Extending from the regulator 60 to supply fossil fuel to the heater 24 is the conduit means 61, which is connected to heater 24 in such a way that it does not interfere with rotation of the heater 24 about its horizontal axis. The conduit 61 preferably comprises a flexible hose which passes through the hollow interior of the shaft stub 25 at the front of the carriage 11—as illustrated in FIGS. 10 and 11—and then is connected up at the top thereof to the fuel inlet to the heater 24—as illustrated in FIGS. 9 and 11. An electrical wire 62 also is provided which merely connects up to the conventional interior electrical spark ignition for the heater 24, and may be connected up to any suitable electrical source mounted on the carriage 11, or temporarily connected thereto during start up.

While the elements 36, 37, 38 will hold the heater 24 in a position in which it has been rotated with respect to the upright supports 35 when in actual use, the clamping action provided thereby is not secure enough for transportation. During long distance transport, the forces that are applied to the heater 24 could cause some relative rotation despite the clamping action of the elements 36 through 38'. In order to guard against this, structures 64 through 66 are provided (see FIGS. 10 and 11). Structure 64 comprises a stop bolt, the structure 65 a threaded (internally) collar welded to the casing 26, and the element 66 a flange connected to the internally threaded element 65 for receipt of the bolt 38' through an opening therein. When the bolt 38' passes through the opening in the flange 66 and the wing nut 38 is tightened down, the heater 24 is positively prevented from rotating about the axis defined by the shaft stubs 25.

The bolt 64—as earlier indicated—also performs a "stop" function. Once the assembly 10 is towed to the area that is to be heated thereby, the flange 66 is disconnected from the bolt 38' (see FIG. 11), allowing for rotation when the wing nuts 38 are loosened, and the bolt 64 will engage the sides of the vertical supports 35 to prevent more than one revolution of rotation of the heater 24 with respect to the supports 35, to insure that the hose 61 will not be twisted. Depending upon the width of the support 35, almost a complete 360° rotation of the heater 24 with respect to the supports 25 is provided. However, if a stopping action is not desired or for any reason (e.g. it is necessary to move past the stop at a particular location), the bolt 64 is simply unthreaded. If conventional rotatable bearings are provided for the hose 61 connection to the heater 24, and the like connection for the electrical line 62, then the stop may not be necessary.

According to the invention, a method of space heating a cold area utilizing an infrared fossil powered space heater 24 is provided. The method comprises the steps of transporting the mobile carriage 11 to a cold area by towing it to the cold area, utilizing a trailer hitch 20 and the like, with a motor vehicle. Then the supply and combustion of fossil fuel to the space heater 24 is initiated by operating the regulator 60 so that propane from the tanks 57 flows through line 61 to the heater 24, and electricity is applied through the wire 62 to cause spark ignition within the heater 24. Either before or after the heater 24 is "turned on", the heater 24 is rotated about its axis to position the radiating face thereof in the desired orientation in the cold area to heat the cold area as desired (e.g. see FIGS. 6 through 8 as examples).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A portable space heating assembly comprising:

a carriage mounted on wheels;

an infrared, fossil fuel powered space heater having a radiating face;

means for mounting said heater on said carriage for rotation about an axis so that the orientation of said radiating face with respect to said carriage may be horizontal, and may be changed by at least about 90°, yet said heater may be maintained in the position to which it has been rotated, comprising a pair of shafts, at least one of said shafts being hollow; and conduit means for connecting said heater to a source of fossil fuel so that there is no interference with the rotation of said heater about said axis of rotation.

2. An assembly as recited in claim 1 further comprising means for mounting said source of fossil fuel on said carriage.

3. An assembly as recited in claim 2 wherein said source of fossil fuel comprises at least one tank mounted on said carriage.

4. An assembly as recited in claim 3 further comprising infrared shielding extending vertically upwardly from said carriage and disposed between said tank or tanks and heater for fully shielding said tank or tanks from heat from said heater.

5. An assembly as recited in claim 2 wherein said means for mounting said source of fossil fuel on said carriage comprises a plurality of cages for mounting upright tanks of a fuel gas, said cages disposed on opposite ends of said axis of rotation of said heater, and having a dimension of elongation, the dimension of elongation of said cages being substantially perpendicular to said axis of rotation.

6. An assembly as recited in claim 1 further comprising a tow hitch for said carriage at a front end thereof.

7. An assembly as recited in claim 1 wherein said axis of rotation comprises a first, horizontal, axis of rotation; and wherein said wheels are mounted for rotation about a second axis of rotation, said second axis of rotation being horizontal and perpendicular to said first axis of rotation.

8. An assembly as recited in claim 1 wherein said conduit means passes through said at least one hollow shaft.

9. An assembly as recited in claim 1 further comprising stop means for precluding rotation of said heater with respect to said carriage more than one revolution.

10. An assembly as recited in claim 1 wherein said carriage has a support surface that is substantially horizontal, and wherein said support surface has a majority of the area thereof open, and is made of a heat resistant material, so that the radiating face of said heater may be pointed downwardly to radiate heat through said primarily open surface of said support, to heat space below said support.

11. An assembly as recited in claim 1 wherein said heater comprises a radiant tube gas combusting heater.

12. A portable space heating assembly, comprising:

a carriage mounted on wheels;

an infrared, fossil fuel powered space heater having a radiating face;

means for mounting said heater on said carriage for rotation about an axis to that the orientation of said radiating face with respect to said carriage may be changed, yet said heater may be maintained in the position to which it has been rotated;

conduit means for connecting said heater to a source of fossil fuel so that there is no interference with the rotation of said heater about said axis of rotation; and wherein said means for mounting said heater for rotation comprises a pair of upright supports each having a V shaped element at the top thereof, and a cooperating oppositely directed V shaped element mounted in association with said upright support to define a shaft receiving opening; and a pair of shafts, one extending through each of said shaft receiving openings.

13. An assembly as recited in claim 12 further comprising readily releasable fastener means for holding said oppositely directed, cooperating, V-shaped portions of said supports together in a first position to clamp said shafts therebetween so that rotation of said shafts with respect to said supports is not possible, or in a second position to loosely hold said shafts therebetween so that said heater may be rotated about an axis defined by said shafts.

14. A method of space heating a cold area utilizing an infrared fossil fuel powered space heater mounted on a mobile carriage for rotation about an axis to allow adjustment of a radiating face of the heater, wherein the carriage has a supporting bottom surface, the vast majority of the carriage bottom surface being open so that heat may be radiated therethrough; comprising the steps of:

(a) transporting the mobile carriage to a cold area by towing it to the cold area with a motor vehicle;

(b) initiating supply and combustion of fossil fuel to the space heater at the cold area so that heat radiates from the radiating face thereof; and (c) rotating the heater about its axis to position the radiating face in different desired orientations at least about 90° apart, at least one of said orientations being horizontal, in the cold area to heat the cold area as desired, including rotating the heater about its axis so the radiating face thereof faces downwardly, radiating heat through the carriage bottom to heat the space under the carriage bottom.

15. A portable space heating assembly, comprising:

a carriage mounted on wheels;

an infrared, fossil fuel powered space heater having a radiating face;

means for mounting said heater on said carriage for rotation about an axis to that the orientation of said radiating face with respect to said carriage may be changed, yet said heater may be maintained in the position to which it has been rotated;

conduit means for connecting said heater to a source of fossil fuel so that there is no interference with the rotation of said heater about said axis of rotation; and wherein said means for mounting said heater further comprises an exterior casing for said heater, said casing having a pair of shaft stubs associated therewith, and extending from opposite sides thereof.

16. A portable space heating assembly, comprising:

a carriage mounted on wheels;

an infrared, fossil fuel powered space heater having a radiating face;

means for mounting said heater on said carriage for rotation about an axis to that the orientation of said radiating face with respect to said carriage may be changed, yet said heater may be maintained in the position to which it has been rotated;

conduit means for connecting said heater to a source of fossil fuel so that there is no interference with the rotation of said heater about said axis of rotation;

a plurality of fuel gas tanks comprising said source of fossil fuel, and mounted on said carriage, said carriage comprising a pair of side frame members extending substantially the length of said carriage; and a gas conduit extending from one end of said carriage to the other, said gas conduit being mounted on the outside of said frame element so that the body of said frame element is disposed between said gas line and said radiant heater.

17. A portable space heating assembly comprising:

a carriage mounted on wheels;

an infrared, fossil fuel powered space heater having a radiating face;

means for mounting said heater on said carriage for rotation about an axis so that the orientation of said radiating face with respect to said carriage may be horizontal, and may be changed by at least about 90°, yet said heater may be maintained in the position to which it has been rotated;

conduit means for connecting said heater to a source of fossil fuel so that there is no interference with the rotation of said heater about said axis of rotation; and means for mounting said source of fossil fuel on said carriage, comprising a plurality of cages for mounting upright tanks of a fuel gas, said cages disposed on opposite ends of said axis of rotation of said heater, and having a dimension of elongation, the dimension of elongation of said cages being substantially perpendicular to said axis of rotation.

18. A portable space heating assembly comprising:

a carriage mounted on wheels;

an infrared, fossil fuel powered space heater having a radiating face;

means for mounting said heater on said carriage for rotation about an axis so that the orientation of said radiating face with respect to said carriage may be horizontal, and may be changed by at least about 180°, yet said heater may be maintained in the position to which it has been rotated;

conduit means for connecting said heater to a source of fossil fuel so that there is no interference with the rotation of said heater about said axis of rotation; and wherein said carriage has a support surface that is substantially horizontal, and wherein said support surface has a majority of the area thereof open, and is made of a heat resistant material, so that the radiating face of said heater may be pointed downwardly to radiate heat through said primarily open surface of said support, to heat space below said support.

* * * * *